US007533876B2

(12) United States Patent
Sytema

(10) Patent No.: US 7,533,876 B2
(45) Date of Patent: May 19, 2009

(54) COMPACT INSERTER

(75) Inventor: Herman Sytema, Terhorne (NL)

(73) Assignee: NEOPOST Technologies, Bagneux (FR)

( * ) Notice: Subject to any disclaimer, the term of this patent is extended or adjusted under 35 U.S.C. 154(b) by 209 days.

(21) Appl. No.: 11/321,656

(22) Filed: Dec. 29, 2005

(65) Prior Publication Data

US 2006/0163793 A1 Jul. 27, 2006

(30) Foreign Application Priority Data

Dec. 31, 2004 (NL) ..... 1027940

(51) Int. Cl.
*B65H 39/00* (2006.01)

(52) U.S. Cl. ..... 270/58.09

(58) Field of Classification Search ..... 270/58.06; 53/284.3, 381.5, 381.7, 569
See application file for complete search history.

(56) References Cited

U.S. PATENT DOCUMENTS 3,162,435 A * 12/1964 Rastorguyeff et al. ..... 271/2
3,747,297 A 7/1973 Hankins ..... 53/381 R
3,962,848 A 6/1976 Hankins ..... 53/266 A
4,337,609 A * 7/1982 Foster et al. ..... 53/569
4,715,164 A * 12/1987 Luperti et al. ..... 53/381.7
4,813,209 A * 3/1989 Foster et al. ..... 53/381.7
5,327,705 A * 7/1994 DeFigueiredo ..... 53/569
5,507,129 A * 4/1996 Joson et al. ..... 53/55
5,867,967 A * 2/1999 Paradis et al. ..... 53/381.7
6,036,185 A * 3/2000 Baumann et al. ..... 271/2
6,640,521 B2 * 11/2003 Simkins et al. ..... 53/460
6,790,303 B2 * 9/2004 Allen et al. ..... 156/196
2003/0110738 A1 * 6/2003 Simkins et al. ..... 53/460

FOREIGN PATENT DOCUMENTS

CH 453 950 9/1964
DE 1 461 690 1/1969
EP 0 336 674 A2 10/1989

* cited by examiner

*Primary Examiner*—Gene Crawford
*Assistant Examiner*—Leslie A Nicholson, III
(74) *Attorney, Agent, or Firm*—Sughrue Mion, PLLC

(57) ABSTRACT

Inserter provided with an envelope feeder having an envelope supply holder for taking up a stack of envelopes and having a transport roller and a separation element opposite a circumferential portion of the transport roller, for separately dispensing individual envelopes from the envelope supply holder. An envelope transport path extends from the envelope feeder to a stuffing position for transporting envelopes from the envelope feeder to the stuffing position. At least one guide along the envelope transport path downstream of the separation element comprises a flap hold-open element for holding a flap of an envelope held in the stuffing position open, situated opposite a circumferential portion of the transport roller of the envelope feeder.

8 Claims, 2 Drawing Sheets

COMPACT INSERTER

CROSS-REFERENCE TO RELATED APPLICATIONS

This application claims priority from Dutch Patent Application No. NL 1027940, filed on Dec. 31, 2004.

FIELD AND BACKGROUND OF THE INVENTION

This invention relates to an inserter. In U.K. patent No. 1,084,262 an example of such an inserter is disclosed. The inserter includes a system for unstacking envelopes and for opening the flaps of unstacked envelopes. Separate apparatuses for that purpose are known from U.S. Pat. No. 3,747,297, U.S. Pat. No. 3,962,848 and U.S. Pat. No. 6,036,185.

In practice, apparatuses as mentioned above are typically used in mailrooms where large numbers of documents or sets of documents are each to be inserted in an envelope in order to send these documents to addresses.

However, also in small organizations that send relatively small numbers of documents, and where the documents to be sent are for a considerable part processed by hand also when being prepared prior to insertion, mechanized insertion could lead to considerable saving of labor. To be considered here are, for instance, medical practices, workshops and club administrations, as well as service companies taking care of sending smaller mailings for third parties. Accordingly, there is a need for inserters that are compact enough and simple enough to be attractive in cost price and complexity of operation for application on a smaller scale than existing inserters.

SUMMARY OF THE INVENTION

It is an object of the invention to provide a solution enabling a simpler and more compact structure of an inserter.

This object is achieved according to the invention by providing an inserter according to claim 1. As the flap hold-open element for holding the flap of the envelope held in the stuffing position open is situated opposite a circumferential portion of the transport roller which also serves, in cooperation with the separation element, for transporting envelopes one by one from the envelope holder, the envelopes, at transport from the envelope holder, can be further driven by this transport roller and to that end on the side of that transport roller no further provisions for transporting the envelopes are necessary. Thus, a more compact structure and a simpler construction are enabled.

Embodiments of the invention are laid down in the dependent claims. Further features, effects and details of the invention are illustrated and elucidated on the basis of an exemplary embodiment with reference to the drawing.

DETAILED DESCRIPTION

Figure 1:
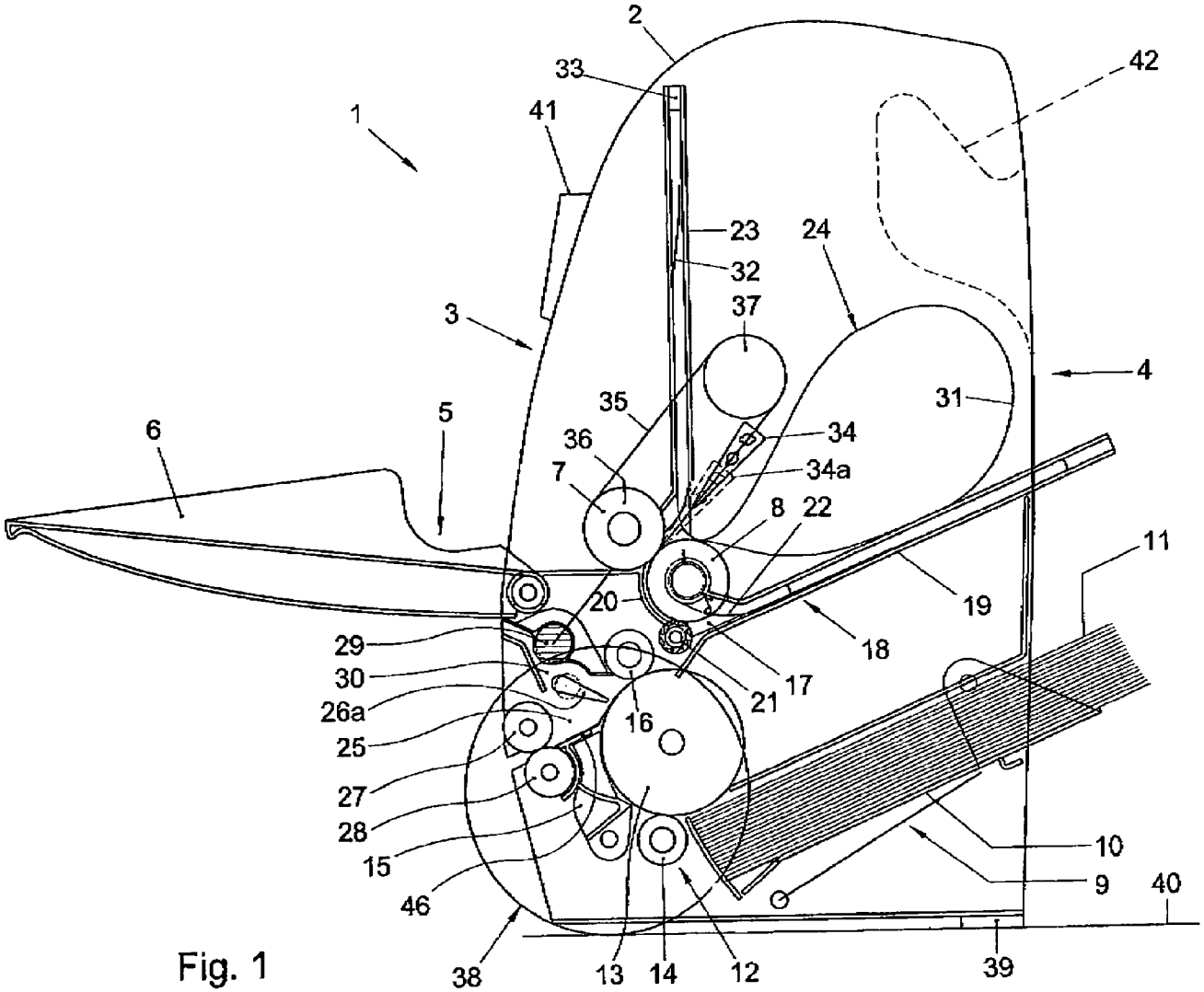
FIG. 1 is a cutaway side elevation of an example of an inserter according to the invention.

The inserter 1 according to the example represented in the drawing has a housing 2 with a front side 3 and a rear side 4.

On the front side 3 is a document feeder 5 with a document holder 6 for taking up a document (not shown) and with a dispenser formed by a pair of folding rollers 7, 8 for dispensing a document from the document holder 6. The document holder 6 at the same time forms a cover of the housing 2, adapted to be hinged between the open position represented and a closed position not represented.

On the rear side 4 is an envelope feeder 9 with an envelope holder 10 for taking up a stack of envelopes 11 and with a separator 12 for separately dispensing individual envelopes from the holder 10. According to this example, the separator 12 is equipped with a transport roller 13 for taking up envelopes and a separation element in the form of a separation roller 14 for each time stopping next envelopes, so that each time a single envelope can be dispensed off the top of the stack 11. Instead of a separation roller, other separation elements can be employed for each time stopping an envelope not yet to be transported, such as a boundary of a separation slit or fingers or grippers for mechanical and/or pneumatic engagement of an envelope not yet to be transported.

An envelope transport path between the envelope feeder 9 and a stuffing position serves for transporting envelopes 11 from the envelope feeder 9 to the stuffing position. The envelope transport path extends between on the one hand the transport roller 13 and on the other hand a guide 15, a switch valve 26, a mail item output path guide 46 and a guide roller 16 which function as guide devices.

The guide 15, which also serves as scraper for opening the flap of the passing envelope, and the guide roller 16 guide the envelope during operation, so that it is held against the circumferential surface of the transport roller 13, until an inlet 17 of a stuffing assembly 18 is reached. When the envelope has arrived in the stuffing position, the guide roller 16 retains the flap of the envelope against the transport roller 13. The guide roller 16 thus forms at the same time a flap hold-open element. That the flap hold-open element 16 is situated opposite the transport roller 13 which, in cooperation with the separation element 14, also takes care of the separation and transport of envelopes from the envelope holder 10, provides the advantage that the transport roller 13 takes care of guidance and transport of envelopes up to the stuffing position. Accordingly, there is no further provision needed for driving the envelopes along the envelope transport path and consequently the envelope transport path has a short length, which is advantageous for a compact structure.

That the scraper or guide 15 for opening a flap of an envelope passing along the envelope transport path towards the stuffing position is situated opposite the transport roller 13 which, in cooperation with the separation element 14, also takes care of separation and transport of envelopes from the envelope holder 10, provides the advantage that the transport roller 13 also takes care of the transport along the provisions 15 for these operations, which further contributes to the simplicity of construction and the compact structure.

Figure 2:
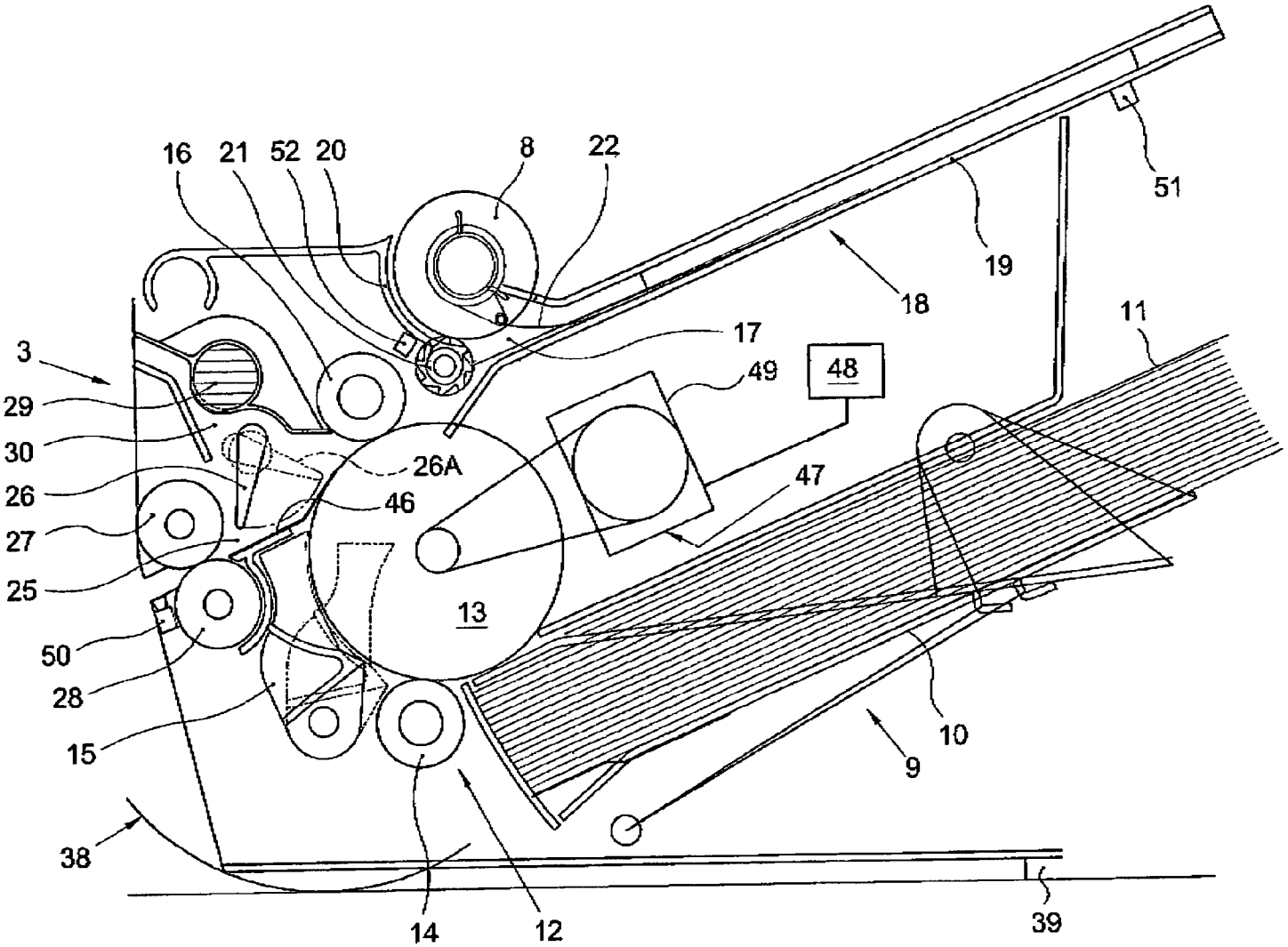
FIG. 2 is a larger representation of a lower portion of the inserter represented in FIG. 1.

The scraper or guide 15 according to this example is pivotable between a wait position 15*a* represented with broken lines in FIG. 2 and a scrape position 15 represented with full lines. When an envelope runs against the scraper in the wait position 15*a*, the scraper is tilted to the scrape position, in which a scrape edge presses against the passing envelope and hooks on the flap standing clear of the body of the envelope to some extent as a result of its bending around the transport roller, thereby folding it open. When the body of the envelope has reached the stuffing position in the envelope holder 19, the opened flap is retained between the flap hold-open element 16 and the transport roller 13.

What also contributes to simplicity of construction and a compact structure is that also guides 26, 46 for guiding a flap of an envelope passing along the envelope transport path away from the stuffing position, to a moistener 30 are situated opposite the transport roller 13 which, in cooperation with the separation element 14, also takes care of separation and transport of envelopes from the envelope holder 10. Also the movement of the flap of the envelope along the moistener 30 can thus be driven by this transport roller 13.

That the guide 46 forming a switch for guiding an envelope passing along the envelope transport path away from the stuffing position to a mail item output path 25 is situated opposite the transport roller 13 which, in cooperation with the separation element 14, also takes care of separation and transport of envelopes from the envelope holder 10, provides the advantage that also the displacement of the stuffed envelope to and, at least over some distance, into the mail item output path 25 can be driven by this transport roller 13. For this purpose, then, no separate transport roller is needed.

The stuffing assembly 18 is equipped with a holder 19 for each time holding an envelope in the stuffing position and with guides 22 for each time guiding a document into an envelope in the stuffing position.

A document transport path for transporting documents from the document feeder 5 to the stuffing position extends from the document feeder 5 and has a branch passing between and through the folding rollers 7, 8 and terminating in a buckle chute 23. Laterally of the buckle chute 23 there is room to allow a document 24 to be folded to buckle into a loop.

The folding rollers 7, 8 extend throughout the width of the document transport path, so that they can form a fold extending throughout the width of the document 24.

A first section 31 of the document 24, measured from a folding nip between the folding rollers 7, 8 along the document 24, is located closer to the folding nip than is a second section 32. For causing the first section 31 of the document 24 to buckle into a loop, the folding rollers 7, 8 are drivable in an input rotation sense, and an arrester is provided in the form of a stop 33 in the buckle chute 23 for arresting a portion of the document 24 downstream of the folding rollers 7, 8 with respect to the portions of the document 24 transported between the folding rollers 7, 8.

Means for bending the second section 32 of the document 24 to the folding nip are formed, according to this example, by a folding blade 34 which is reciprocable between the positions designated with reference numerals 34 and 34*a*. To this end, the folding blade 34 is attached to a pair of toothed belts 35 which pass around rollers 36, 37 and which are coupled with the drive of the folding rollers 7, 8 via a clutch (not shown).

The folding rollers 7, 8 are further drivable in an output rotation sense, such that the second section 32 of the document 24 is transported into the folding nip.

In operation, the folding of a document 24 in the apparatus shown starts with introducing the document 24 into the folding nip between the folding rollers 7, 8. Next, to cause the first section 31 of the document 24 to buckle into a loop, the folding rollers 7, 8 are rotated further in the input rotation sense, whereby portions of the document 24 situated between the folding rollers 7, 8 are transported further. Relative to the portions of the document 24 transported between the folding rollers 7, 8, the portion 32 of the document 24 downstream of the folding rollers 7, 8 is arrested in that it butts against the stop 33 in the buckle chute 23.

Rotating the folding rollers 7, 8 is then continued, until the operative condition represented in the drawing has been reached, in which a trailing end portion of the document 24 is just retained between the folding rollers 7, 8.

Next, the second section 32 of the document 24 is urged to the folding nip, in that the folding blade 34, on a side of the document 24 remote from the folding nip is moved towards the folding nip, into the position designated with reference numeral 34*a*.

The folding rollers 7, 8 are then rotated in an output rotation sense, whereby the sections of the folding rollers 7, 8 in the area of the folding nip transport the second section 32 into the folding nip and a first fold is formed.

Next, the folding rollers 7, 8 rotate further, so that also the first section 31 of the document 24 is transported through the folding nip and a second fold, spaced from the first fold, is formed in that the loop is folded flat.

When the document 24 has been outputted, the folding blade 34 is moved back to its initial position. This can for instance be done during the input of a next document 24 to be folded.

Further, the document transport path proceeds between a lower one of the folding rollers 8 and guides 21, 22 in the form of a plate 21 and a roller 22 to the stuffing position, for transporting folded documents to the stuffing position.

As, on the side of the document transport path where also the flap hold-open element 16 is situated, the most downstream guide 21 of the document transport path is situated opposite one of the folding rollers 8, the documents, upon transport from the nip between the folding rollers 7, 8 until their reaching the stuffing position, can be driven by one of the folding rollers 8 and on the side of that folding roller 8 no further provisions for transporting the documents are needed. Accordingly, for the transport of the documents from between the folding rollers 7, 8 to the stuffing position, a short transport path is obtained, which is advantageous for a compact structure. Moreover, drive by the folding roller 8 can suffice, which is advantageous for constructional simplicity.

The most downstream guide 21 of the document transport path on the side of the document transport path where also the flap hold-open element 16 is situated, is designed as a transport roller which abuts against the one of the folding rollers 8 around which the document transport path proceeds. This guide 21, along with the folding roller 8 against which it rests, forms a nip for engagement of documents to be transported to the stuffing position. As a consequence, in operation, at that last guide, a thrust towards the stuffing position can be exerted on the documents. Thus, the documents are reliably pushed into the envelope present in the stuffing position.

The branch of a document transport path extending between the folding rollers 7, 8 and the envelope holder 19 bounding the stuffing position jointly define a V-shaped path, of which a bottom portion is bounded by a circumferential portion of one of the folding rollers 8. Such a folded-up configuration, which may also be U-shaped, of these two dead-end transport paths is advantageous for a compact structure of an inserter.

Together with the envelope feeder 9, these dead-end transport paths moreover form a W-shaped system of transport paths, of which one bottom portion is bounded by a circumferential portion of one of the folding rollers 8 and another bottom portion is bounded by a circumferential portion of the transport roller 13 of a separator 12 of the envelope feeder 9 for dispensing individual envelopes one by one. Such a configuration, in which the path portions for supplying and processing components into a mail item project like fingers, with each time only a roller between two successive ones of the fingers, further contributes to simplicity of construction and compact build.

The mail item output path 25 is connected with the stuffing position for transporting stuffed envelopes from the stuffing position, branches off from the envelope transport path between the flap hold-open element 16 and the separation element 14, and proceeds along a switch valve 26 for closing the flap of the envelope and between a pair of output rollers 27, 28.

The output rollers 27, 28 also form an exit for delivering stuffed envelopes transported along the mail item output path 25. Along a side of the switch valve remote from the mail item output path 25 extends a branch 30 for guiding the flap of the envelope to a moistener 30. The switch valve 26 is arranged, each time upon the further transport of an envelope, after the flap thereof has been moistened by the moistener 30, to pivot along with the envelope from the position shown to a position directed more towards the output rollers 27, 28. The flap of the envelope is thereby closed. The output rollers 27, 28 also serve for pressing on the closed flap of the envelope.

The transport roller 13 is coupled with a drive 47 for driving the transport roller 13 in an input rotation sense for transport of envelopes to the stuffing position and in an output rotation sense opposite to the input rotation sense for transport of envelopes from the stuffing position. In this way, both the input and the output of the envelopes can be driven via the same transport roller 13.

For controlling the drive, there is provided a control 48 which is connected with a motor 49 of the drive 47. Situated adjacent the output rollers 27, 28 is a sensor 50, connected with the control 48, for scanning the passage of an envelope in the mail item output path 25. The control is arranged, in response to the detection of the passage of an envelope in the mail item output path 25, to drive the transport roller 13 in the input rotation sense, optionally with a suitable delay. As a result, when a ready mail item has been discharged, a next envelope is supplied.

The envelope holder 19 is provided with a sensor 51, connected with the control 48, for detecting an envelope in the stuffing position. The control 48 is arranged for stopping the drive 18 of the transport roller 13 and for starting the supply of documents in response to the detection of the envelope by the sensor.

Furthermore, there is provided a sensor 52, connected with the control 48, for scanning the passage of a document in the document transport path. The control 48 is arranged, in response to the detection of the passage of a document in the document transport path, to drive the transport roller 13 in the output rotation sense. As a result, a stuffed envelope is transported into the mail item output path 25.

That the document feeder 5 and the exit 27, 28 are situated at the ront of the housing 2 provides the advantage that these are easily operable for a user operating the inserter 1 from a workplace. The document feeder 5 in which the user must each time place documents to be inserted is moreover well accessible because it is situated above the exit 27, 28.

That the envelope holder 10 is accessible exclusively from a rear side of the housing then provides the advantage that it does not occupy any space at the front, thus enabling a compact structure.

The housing 2 has feet 38, 39, 41 for supporting the housing 2 via these feet 38, 39, 41 on a supporting surface 40 on which the apparatus stands. According to this example, the feet 38, 39, 41 are positioned in pairs and of each pair of feet 38, 39, 41 one is visible in the side elevational view. The feet 38, 39, 41 are arranged for allowing rotation of the housing 2 between the operating position and a loading position while it rests via a set 38 of those feet 38, 39, 41 on the supporting surface 40, and for keeping the housing 2 supported in the two positions. The apparatus 1 in the operative position then rests by the feet 38, 39 on the supporting surface 40, while a set 41 of the feet are situated at the front of the housing 2. In the loading position, the apparatus rests by the feet 38, 41 on the supporting surface 40, while a set 39 of the feet are situated on a rear side of the housing 2.

In the loading position, the original rear side 4 of the housing 2 faces up, so that the envelope holder 10, which is accessible exclusively from the side 4 of the housing 2 that faces rearwards in the operative condition, is readily accessible to the user without him needing to leave his workplace.

To further facilitate the housing 2 being moved back and forth between the two positions mentioned, it is provided with a grip 42 adjacent its upper end. In the condition of use, this grip 42 is situated at the rear side and in the loading condition at the upper side of the housing 2, so that the grip can easily be held while changing the position of the housing without requiring to be regripped.

The invention claimed is:

1. An inserter, comprising:

an envelope feeder having an envelope supply holder for taking up a stack of envelopes and having a transport roller and a separation element opposite a circumferential portion of the transport roller, for separately dispensing individual envelopes from the envelope supply holder;

a stuffing assembly with an envelope holder for each time holding an envelope in a stuffing position;

a document feeder for dispensing documents;

a document transport path between the document feeder and the stuffing position for transporting documents from the document feeder to the stuffing position;

an envelope transport path extending from the envelope feeder to the stuffing position for transporting envelopes from the envelope feeder to the stuffing position; and at least one guide device for guiding the envelopes along the envelope transport path downstream of the separation element, the at least one guide device comprising a flap hold-open element for holding a flap of an envelope held in the stuffing position open between the flap hold-open element and said transport roller;

wherein the flap hold-open element is situated opposite a circumferential portion of said transport roller and wherein the transport roller transports the envelopes along the envelope transport path.

2. An inserter according to claim 1, wherein the at least one guide device comprises a scraper for opening a flap of an envelope passing along the envelope transport path towards the stuffing position.

3. An inserter according to claim 1, wherein the at least one guide device comprises a guide for guiding a flap of an envelope passing along the envelope transport path away from the stuffing position, to a moistener.

4. An inserter according to claim 1, wherein the at least one guide device comprises a switch for guiding an envelope passing along the envelope transport path away from the stuffing position, to a mail item output path.

5. An inserter according to claim 1, further comprising a mail item output path connected with the stuffing position for transporting stuffed envelopes from the stuffing position, which mail item output path branches off from said envelope transport path between the flap hold-open element and the separation element.

6. An inserter according to claim 5, wherein the transport roller is coupled with a drive for driving the transport roller in an input rotation sense for transport of envelopes to the stuffing position and in an output rotation sense opposite to the input rotation sense for transport of envelopes out of the stuffing position.

7. An inserter according to claim 6, further comprising at least one sensor for scanning the passage of an envelope in the mail item output path, and a control for driving said transport roller in the input rotation sense in response to the detection of the passage of an envelope in the mail item output path.

8. An inserter according to claim 6, further comprising at least one sensor for scanning the passage of a document in the document transport path, and a control for driving said transport roller in the output rotation sense in response to the detection of the passage of a document in the document transport path.

* * * * *